United States Patent [19]

Hopkins

[11] 4,040,350

[45] Aug. 9, 1977

[54] ROTARY PRINTER

[75] Inventor: Roger A. Hopkins, Herrin, Ill.

[73] Assignee: Diagraph-Bradley Industries, Inc., Herrin, Ill.

[21] Appl. No.: 701,584

[22] Filed: July 1, 1976

[51] Int. Cl.[2] ..... B41F 13/10

[52] U.S. Cl. ..... 101/376; 101/328

[58] Field of Search ..... 101/376, 375, 377, 379, 101/380, 328, 35, 329, 330, 331

[56] References Cited

U.S. PATENT DOCUMENTS

| | | | |
|---|---|---|---|
| 2,631,535 | 3/1953 | Mumma | 101/376 |
| 2,634,676 | 4/1953 | McKay | 101/376 X |
| 2,746,389 | 5/1956 | Alessi, Jr. et al. | 101/377 |
| 3,093,070 | 6/1963 | Beaver | 101/376 |
| 3,186,337 | 6/1965 | Hill | 101/377 X |
| 3,824,932 | 7/1974 | Aronson | 101/377 |
| 3,968,747 | 7/1976 | Johnson | 101/376 |

*Primary Examiner*—J. Reed Fisher

*Attorney, Agent, or Firm*—Koenig, Senniger, Powers and Leavitt

[57] ABSTRACT

A rotary printer comprising a wheel having a generally cylindrical surface, and a pair of relatively thin cylindrical ring members slidably positioned side-by-side on the wheel for carrying a series of type members. A clamping member is provided on the wheel for clamping the ring members with the type members therebetween against an abutment on the wheel thereby locking the ring members to the wheel and the type members to the ring members.

10 Claims, 4 Drawing Figures

FIG. 2
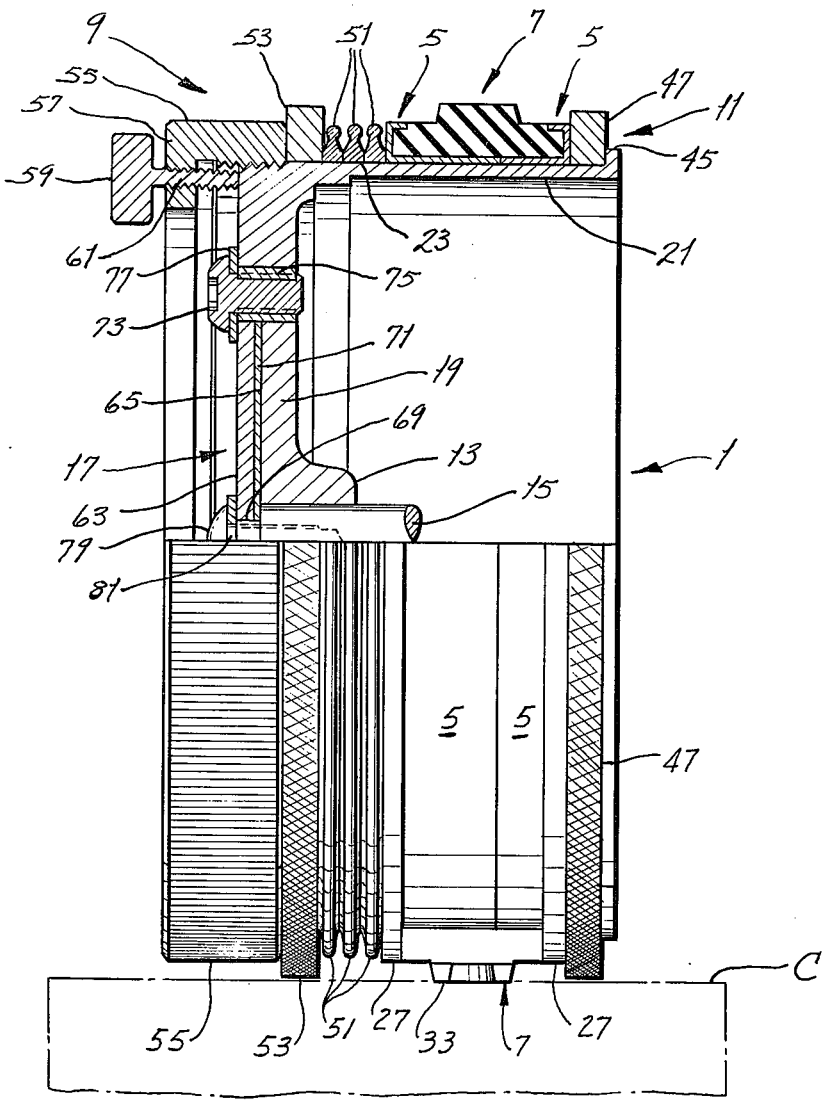
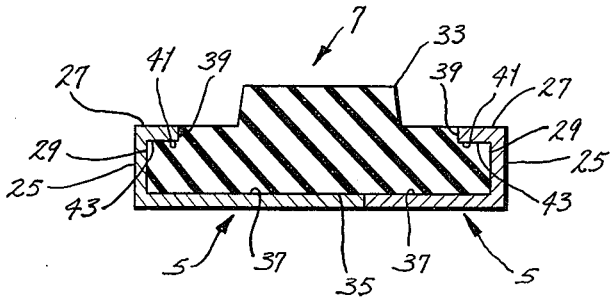
FIG. 3
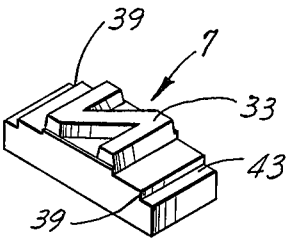
FIG. 4

ROTARY PRINTER

BACKGROUND OF THE INVENTION

This invention relates to rotary printers, and more particularly to a rotary printer useful for high-speed printing of codes or other indicia on articles such as cases or cartons as they are conveyed one after another along a predetermined path.

The invention is especially concerned with a rotary printer comprising a wheel carrying interchangeable type for the above-noted purpose. Printers of this class have been widely used, and the prior printers have been generally satisfactory for low-speed printing operations, but have not been generally satisfactory for high-speed printing operations, due to their being prone to having the type knocked loose on high-speed rotation of the wheel.

SUMMARY OF THE INVENTION

Accordingly, among the several objects of this invention may be noted the provision of an improved rotary printer of the class described having a type-holding wheel wherein the type is securely held on the wheel for high-speed printing operations, while being readily removable and replaceable for changing type; and the provision of a rotary printer with such a wheel which is economical to manufacture, reliable in operation and easy to use.

In general, a rotary printer of this invention comprises a wheel and a pair of relatively thin cylindrical ring members slidably mounted side-by-side on the wheel. Each ring member has a radially outwardly extending flange at the side thereof away from the other ring member, and each flange has a lip at its outer edge extending inwardly toward the other flange and spaced radially outwardly from the respective ring member for defining inwardly directed opposed annular grooves at opposite sides of the ring member. The ring members carry a series of type members each comprising a block of elastomeric material having an inside face engageable with the outside faces of the ring members with the ends of the block received in the grooves, and with a raised type face extending outwardly from the block between the lips. Abutment means extends radially outwardly from the wheel and is axially engageable by the flange of one of the ring members. Clamping means on the wheel clamps the ring members with the type members therebetween against the abutment means thereby locking the ring members to the wheel and the type members to the ring members. Other objects and features will be in part apparent and in part pointed out hereinafter.

BRIEF DESCRIPTION OF THE DRAWINGS

FIG. 2 is a section on line 2—2 of FIG. 1;

FIG. 3 is an enlarged fragment of FIG. 2 showing the ring members and one of the type members therebetween; and FIG. 4 is a perspective of one of the type members.

Corresponding reference characters indicate corresponding parts throughout the several views of the drawings.

DESCRIPTION OF A PREFERRED EMBODIMENT

Figure 1:
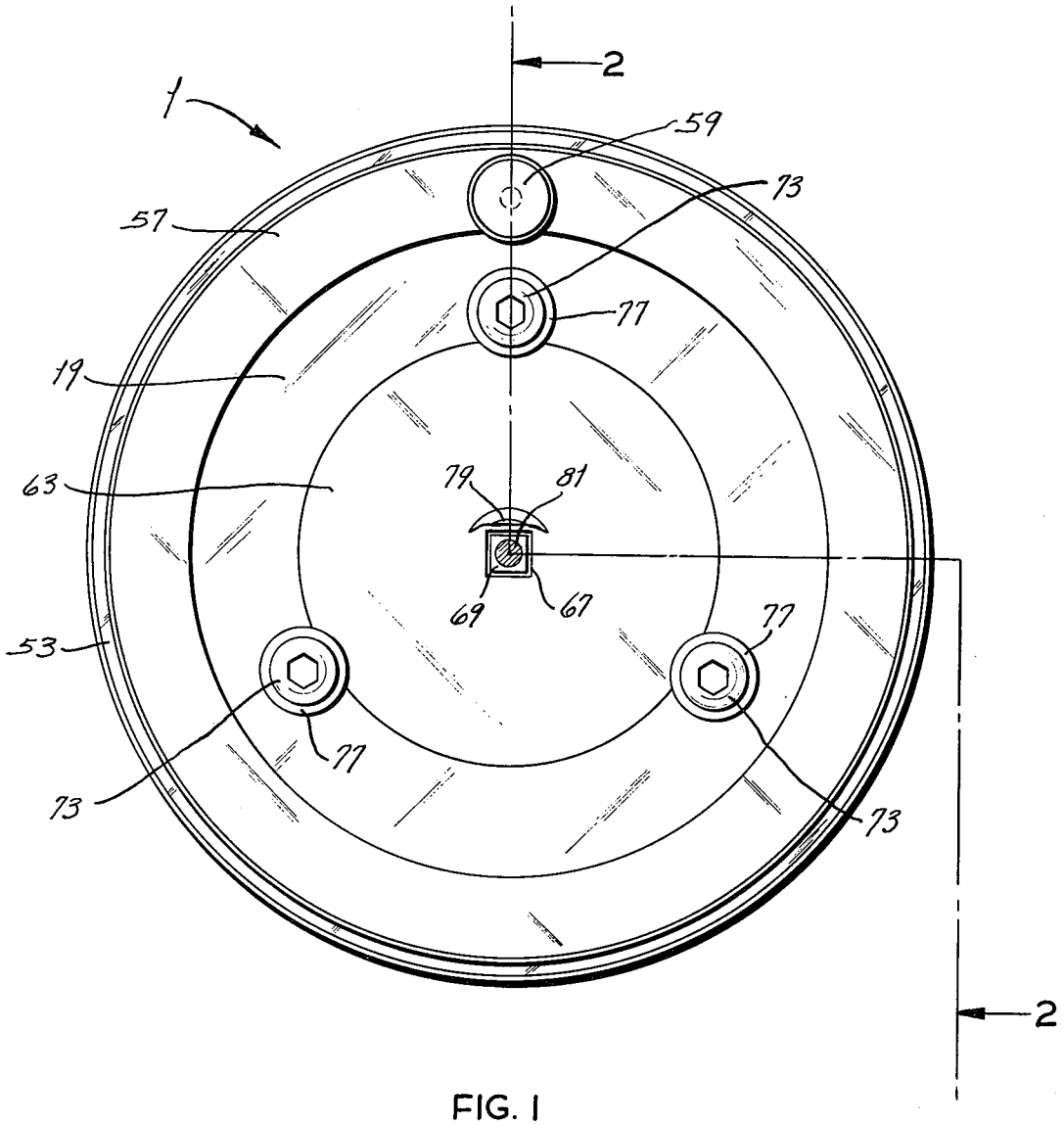
FIG. 1 is a side elevational view of the rotary printer of this invention.

Referring to the drawings, a rotary printer of this invention is shown to comprise a wheel 1 having a generally cylindrical surface, and type-holding ring means on the wheel comprising a pair of relatively thin cylindrical ring members each generally designated 5. The ring members 5 have a sliding fit on wheel, and are positioned side-by-side thereon for carrying a plurality of type members each designated 7. Clamping means generally indicated at 9 is provided on the wheel for clamping the ring members 5 with type members 7 therebetween against abutment means generally indicated at 11 on the wheel thereby locking the ring members to the wheel and the type members to the ring members.

More particularly, the wheel 1 comprises a hub 13 mounted on one end of a shaft 15 and fixedly held thereon by means indicated generally at 17 in FIG. 2. Extending radially outwardly from hub 13 is an integral web portion or disk 19. At 21 is indicated the rim of wheel 1 which is in the form of a drum having an outer cylindrical surface 23 extending axially in one direction (toward the right as viewed in FIG. 2) from the periphery of disk 19, and being formed integrally with the disk.

The ring members 5 are slidably positioned side-by-side on the cylindrical surface 23. Each of these is formed of aluminum, for example, and has a radially outwardly extending flange 25 at the side thereof away from the other. Each flange 25 has a lip 27 at its outer edge extending inwardly toward the other flange 25 for defining inwardly directed opposed annular grooves each designated 29 at opposite sides of ring members 5. The ring members carry a plurality of type members 7, each comprising a block of elastomeric material (e.g., rubber) having a raised type face 33 extending outwardly between lips 27 for printing indicia on a carton or the like. The inside face 35 of each block is engaged with the outside faces 37 of the ring members with the ends of the block received in the annular grooves 29. It is important to note that the length of type block 7 from one end to the other is greater than the sum of the widths of outside faces 37 of ring members 5, thereby allowing compression of the block between fanges 25 of the ring members for fixedly holding type blocks 7 on the ring members. More particularly, the ends of the type block 7 have rabbets therein each indicated at 39 for receiving the corresponding lip 27 with the inside face 41 of the lip coextensive with the face 43 of the rabbet. Thus, with the ring members 5 clamped together between clamping means 9 and abutment means 11, type block 7 is compressed between flanges 25 thereby providing a positive gripping force fixedly securing the type blocks on the ring members.

Abutment means 11 on the rim 21 of wheel 1 to the right of ring members 5 comprises a peripheral flange 45 extending radially outwardly from rim 21 and a first friction ring indicated at 47 having a knurled outer periphery for rotatably engaging the surface of a carton to be printed. This first friction ring is slidably mounted on cylindrical surface 23 of the wheel with its right side engaged with peripheral flange 45 and its left side for engagement by flange 25 of right member 5. Although friction ring 47 is shown to be independently slidable on wheel 1, it is to be understood that it may be formed integrally with the rim of the wheel, omitting the peripheral flange 45. Immediately to the left of the ring members and slidably fitted on cylindrical surface 23 are three annular spacers each designated 51 constituting means for adjusting the position of ring members 5 lengthwise of rim 21. With the spacers so located and right ring member 5 abutting first friction ring 47, the ring members (with type blocks 7 therebetween) are positioned as far to the right as possible on the rim of the wheel. To position the ring members farther to the left on the rim, a spacer 51 (or spacers) may be moved from its position as shown in FIG. 2 to a position between the first friction ring 47 and the right ring member 5.

Clamping means 9 for clamping ring members 5 against abutment means 11 comprises a second friction ring 53 similar to first friction ring 47 slidable on cylindrical surface 23 having its right side engaging the spacers 51, and a locking ring 55 immediately to the left of the second friction ring. Locking ring 55 is threaded on the end of rim 21 of wheel 1 for pressing the second friction ring 53, spacers 51 and ring members 5 toward abutment means 11 thereby locking the entire assembly to the wheel for conjoint rotation. The left side of locking ring 55 (as viewed in FIG. 2) extends axially beyond the rim 21 of wheel 1 and has a flange 57 extending radially inwardly therefrom. A thumbscrew 59 is threaded in a tapped axial bore 61 in flange 57 and frictionally engages disk 19 for preventing relative movement between the rim and the locking ring during rotation of the wheel (i.e., for preventing the locking ring from unthreading on the rim).

Generally indicated at 17 is means for securing hub 13 to shaft 15 comprising a retaining washer 63 and a friction washer 65 each having a square hole 67 therein, and a stud 69 of square cross-section extending axially from one end of shaft 15. The retaining washer 63 and the friction washer 65 are mounted on stud 69 and are received in an annular recess 71 in disk 19 with friction washer 65 sandwiched between disk 19 and retaining washer 63 and the retaining washer flush with the disk. For locking washers 63 and 65 to the disk 19 means 17 further includes three screws each designated 73 threaded into inserts 75 in the disk with each screw spaced equidistantly from each other and radially outwardly of annular recess 71 (FIGS. 1 and 2). Each screw 73 is provided with a washer 77 which bears against both disk 19 and retaining washer 63 for preventing relative movement therebetween. Thus, with the retaining washer and the friction washer mounted on stud 69 and screws 73 tightened against the retaining washer 63 and the disk 19, shaft 15 and disk 19 are locked together for conjoint rotation during the printing process. A fourth screw 79 having a washer 81 thereon is threaded into a tapped axial bore in stud 69 with the washer bearing against retaining washer 63.

In operation, the knurled outer peripheries of friction rings 47,53 rotatably engage a carton C moving in a direction toward the viewer as seen in FIG. 2. As wheel 1 rotates due to the movement of carton C, the raised type faces 33 of type blocks 7 successively engage the surface of the carton being printed thereby printing the appropriate indicia on the surface of carton C. Type faces 33 are continuously supplied with ink by means of a suitable preinked annular cartridge (not shown in the drawings).

To replace the type blocks 7, thumbscrew 59 is unthreaded to a retracted position away from disk 19 thereby to allow locking ring 55 to be partially unthreaded on the rim 21 of wheel 1 so as to permit ring members 5 to be separated. With the ring members sufficiently drawn apart, the type blocks 7 may be removed and new type blocks inserted in the ring members with the ends of each type block 7 in annular grooves 29 and the lips 27 received in rabbets 39. Locking ring 55 is then threaded back to its locking position thereby clamping the entire assembly (i.e., second friction ring 53, spacers 51 and ring members 5 with the type blocks 7 therebetween) against abutment means 11 for conjoint rotation with the wheel 1. For preventing the locking ring 55 from unthreading on the rim 21 of the wheel, thumbscrew 59 is moved into engagement with disk 19. As previously mentioned, the length of type block 7 from one end to the other is greater than the sum of the widths of the outside faces 37 of the ring members. Thus, with ring members 5 clamped together, each type block is compressed between lips 27 thereby providing a positive gripping force for fixedly holing the type members on the ring members during high-speed printing.

Ring members 5 may be axially relocated between friction rings 47 and 53 by unthreading locking ring 55 from the rim 21 of the wheel thereby to allow the second friction ring 53, spacers 51 and ring members 5 to be slidably removed in succession from cylindrical surface 23. It will be understood that first friction ring 47 may also be removed from the rim of the wheel but that this will usually be unnecessary. The spacers 51 and ring members 5 are then slid back onto the rim 21 of the wheel with the spacers appropriately repositioned at either or both sides of the ring members thus relocating the ring members 5 with type blocks 7 therebetween lengthwise of cylindrical surface 23. After the second friction ring 53 has been slidably mounted on the wheel, the locking ring 55 is rethreaded onto the rim and thumbscrew 59 is tightened against disk 19 as described above.

As seen from the above discussion, the improved rotary printer of this invention enables type members to be quickly and easily replaced without the use of any tools while providing means for securely holding type during high-speed printing. The simple design of the rotary printer also assures reliability in operation and economical manufacture.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A rotary printer comprising a wheel having a generally cylindrical surface, type-holding ring means on the wheel, said ring means comprising a pair of relatively thin cylindrical ring members having a sliding fit on the wheel, said ring members being positioned side-by-side on the wheel, each of said ring members having a radially outwardly extending flange at the side thereof away from the other ring member, each of said flanges having a lip at its outer edge extending inwardly toward the other flange spaced radially outwardly from the respective ring member, said lips defining inwardly directed opposed annular grooves at opposite sides of the ring members, a series of type members on said ring members, each type member comprising a block of elastomeric material having an inside face engageable with the outside faces of said ring members and extending across said ring members with the ends of the block received in said grooves, with a raised type face extending outwardly from the block between said lips, abutment means extending radially outwardly from the wheel axially engageable by the flange of one of said ring members, and means on the wheel for clamping said ring members with the type members therebetween against said abutment means thereby to lock said ring members to the wheel and said type members to said ring members.

2. A rotary printer as set forth in claim 1 wherein the block is dimensioned relative to said ring members for compression of said block between the flanges of said ring members.

3. A rotary printer as set forth in claim 2 wherein the length of the block from one end to the other is greater than the sum of the widths of said outside faces of said ring members.

4. A rotary printer comprising a wheel having a generally cylindrical surface, type-holding ring means on the wheel, said ring means comprising a pair of relatively thin cylindrical ring members having a sliding fit on the wheel, said ring members being positioned side-by-side on the wheel, each of said ring members having a radially outwardly extending flange at the side thereof away from the other ring member, each of said flanges having a lip at at its outer edge extending inwardly toward the other flange spaced radially outwardly from the respective ring member, said lips defining inwardly directed opposed annular grooves at opposite sides of the ring members, a series of type members on said ring members, each type member comprising a block of elastomeric material having an inside face engageable with the outside faces of said ring members and extending across said ring members with the ends of the block received in said grooves, with a raised type face extending outwardy from the block between said lips, abutment means extending radially outwardly from the wheel axially engageable by the flange of one of said ring members, and means on the wheel for clamping said ring members with the type members therebetween against said abutment means thereby to lock said ring members to the wheels and said type members to said ring members, and wherein the block is dimensioned relative to said ring members for compression of said block between the flanges of said ring members, and wherein said abutment means comprises a peripheral flange extending radially outwardly from said wheel, and a first friction ring mounted on the wheel with one side of the friction ring engageable with the peripheral flange and the other side engageable by the flange of one of said ring members.

5. A rotary printer as set forth in claim 4 wherein said clamping means comprises a second friction ring slidable on the wheel on the opposite side of said ring members from said first friction ring, and a locking ring on the wheel for pressing the second friction ring toward said first friction ring with said ring members therebetween thereby locking said ring members to the wheel and compressing said type members between the flanges of said ring members.

6. A rotary printer as set forth in claim 5 wherein said wheel has means thereon for adjusting the position of the ring members axially of said wheel.

7. A rotary printer as set forth in claim 6 wherein said adjusting means comprises a plurality of annular spacers slidably positioned side-by-side on the wheel, with each spacer adapted to be selectively positioned between said friction rings and said ring members for adjusting the position of the ring members axially of the wheel.

8. A rotary printer as set forth in claim 7 wherein said locking ring is threadably engaged with said wheel, and wherein locking means is provided for preventing relative movement between the locking ring and the wheel.

9. A rotary printer as set forth in claim 8 wherein the side of said locking ring opposite said friction rings extends axially beyond the wheel and has a flange extending radially inwardly therefrom, said locking means comprising a screw threaded in said radially extending flange of the locking ring engageable with the wheel.

10. A rotary printer as set forth in claim 9 wherein the ends of the block are rabbeted to receive said lips.

* * * * *